US006062881A

United States Patent [19]

Ellison

[11] Patent Number: 6,062,881

[45] Date of Patent: May 16, 2000

[54] ELECTRICAL PLUG WITH RETRACTIBLE BLADE COVER MEMBER

[76] Inventor: Mark S. Ellison, 1835 Gilley La., Mobile, Ala. 36612-1167

[21] Appl. No.: 09/096,418

[22] Filed: Jun. 11, 1998

[51] Int. Cl.[7] ..... H01R 13/44

[52] U.S. Cl. ..... 439/141; 439/731

[58] Field of Search ..... 439/141, 140, 439/696, 731

[56] References Cited

U.S. PATENT DOCUMENTS

| | | | |
|---|---|---|---|
| 4,445,739 | 5/1984 | Wooten | 439/140 |
| 4,781,614 | 11/1988 | Ahroni | 439/696 |
| 5,030,119 | 7/1991 | Lowe | 439/141 |
| 5,518,411 | 5/1996 | Belleci | 439/141 |
| 5,831,815 | 11/1998 | Miller et al. | 439/731 |

FOREIGN PATENT DOCUMENTS 672031 10/1964 Italy .

1410679 10/1975 United Kingdom .

*Primary Examiner*—Renee S. Luebke
*Assistant Examiner*—T. C. Patel

[57] ABSTRACT

A new electrical plug with retractible blade cover member for preventing objects from coming in contact with the electrical blades. The inventive device includes a casing with a pair of blade members that extend through the casing. A portion of each of the blade members protrudes outwardly from the inner portion of the front of the casing. The front of the casing has a generally annular cover receiving channel. The channel extends from the front of the casing towards the back of the casing. A blade cover member that substantially covers the blade members is slidably inserted in the cover receiving channel. An outlet contacting portion of the blade cover member has a pair of spaced apart openings through which the blade members extend.

11 Claims, 3 Drawing Sheets

ELECTRICAL PLUG WITH RETRACTIBLE BLADE COVER MEMBER

BACKGROUND OF THE INVENTION

1. Field of the Invention

The present invention relates to electrical plugs and more particularly pertains to a new electrical plug with retractible blade cover member for preventing objects from coming in contact with the electrical blades.

2. Description of the Prior Art

The use of electrical plugs is known in the prior art. More specifically, electrical plugs heretofore devised and utilized are known to consist basically of familiar, expected and obvious structural configurations, notwithstanding the myriad of designs encompassed by the crowded prior art which have been developed for the fulfillment of countless objectives and requirements.

Known prior art electrical plugs include U.S. Pat. No. 4,340,267; U.S. Pat. No. 5,252,082; U.S. Pat. No. 5,030,119; U.S. Pat. No. 4,445,739; U.S. Pat. No. 5,046,961; and U.S. Pat. No. Des. 326,642.

While these devices fulfill their respective, particular objectives and requirements, the aforementioned patents do not disclose a new electrical plug with retractible blade cover member. The inventive device includes a casing with a pair of blade members that extend through the casing. A portion of each of the blade members protrudes outwardly from the inner portion of the front of the casing. The front of the casing has a generally annular cover receiving channel. The channel extends from the front of the casing towards the back of the casing. A blade cover member that substantially covers the blade members is slidably inserted in the cover receiving channel. An outlet contacting portion of the blade cover member has a pair of spaced apart openings through which the blade members extend.

In these respects, the electrical plug with retractible blade cover member according to the present invention substantially departs from the conventional concepts and designs of the prior art, and in so doing provides an apparatus primarily developed for the purpose of preventing objects from coming in contact with the electrical blades.

SUMMARY OF THE INVENTION

In view of the foregoing disadvantages inherent in the known types of electrical plugs now present in the prior art, the present invention provides a new electrical plug with retractible blade cover member construction wherein the same can be utilized for preventing objects from coming in contact with the electrical blades.

The general purpose of the present invention, which will be described subsequently in greater detail, is to provide a new electrical plug with retractible blade cover member apparatus and method which has many of the advantages of the electrical plugs mentioned heretofore and many novel features that result in a new electrical plug with retractible blade cover member which is not anticipated, rendered obvious, suggested, or even implied by any of the prior art electrical plugs, either alone or in any combination thereof.

To attain this, the present invention generally comprises a casing with a pair of blade members that extend through the casing. A portion of each of the blade members protrudes outwardly from the inner portion of the front of the casing. The front of the casing has a generally annular cover receiving channel. The channel extends from the front of the casing towards the back of the casing. A blade cover member that substantially covers the blade members is slidably inserted in the cover receiving channel. An outlet contacting portion of the blade cover member has a pair of spaced apart openings through which the blade members extend.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new electrical plug with retractible blade cover member apparatus and method which has many of the advantages of the electrical plugs mentioned heretofore and many novel features that result in a new electrical plug with retractible blade cover member which is not anticipated, rendered obvious, suggested, or even implied by any of the prior art electrical plugs, either alone or in any combination thereof.

It is another object of the present invention to provide a new electrical plug with retractible blade cover member which may be easily and efficiently manufactured and marketed.

It is a further object of the present invention to provide a new electrical plug with retractible blade cover member which is of a durable and reliable construction.

An even further object of the present invention is to provide a new electrical plug with retractible blade cover member which is susceptible of a low cost of manufacture with regard to both materials and labor, and which accordingly is then susceptible of low prices of sale to the consuming public, thereby making such electrical plug with retractible blade cover member economically available to the buying public.

Still yet another object of the present invention is to provide a new electrical plug with retractible blade cover member which provides in the apparatuses and methods of the prior art some of the advantages thereof, while simultaneously overcoming some of the disadvantages normally associated therewith.

Still another object of the present invention is to provide a new electrical plug with retractible blade cover member for preventing objects from coming in contact with the electrical blades.

Yet another object of the present invention is to provide a new electrical plug with retractible blade cover member which includes a casing with a pair of blade members that extend through the casing. A portion of each of the blade members protrudes outwardly from the inner portion of the front of the casing. The front of the casing has a generally annular cover receiving channel. The channel extends from the front of the casing towards the back of the casing. A blade cover member that substantially covers the blade members is slidably inserted in the cover receiving channel. An outlet contacting portion of the blade cover member has a pair of spaced apart openings through which the blade members extend.

Still yet another object of the present invention is to provide a new electrical plug with retractible blade cover member that has two springs that bias the blade cover member towards an extended position, thereby preventing the blade cover member from becoming misaligned and stuck within the casing.

Even still another object of the present invention is to provide a new electrical plug with retractible blade cover member that prevents children or pets from coming in contact with the electrical blade members when the plug becomes partially dislodged from an outlet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
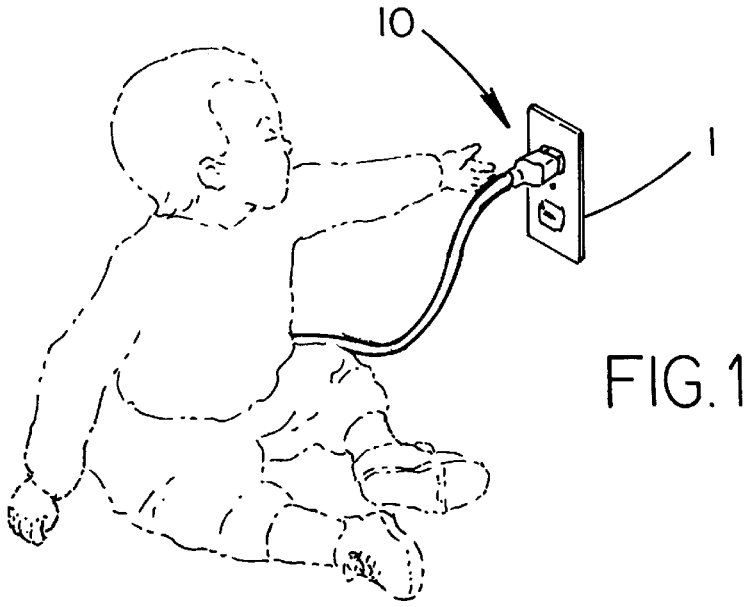
FIG. 1 is a schematic view of a new electrical plug with retractible blade cover member according to the present invention.
Figure 2:
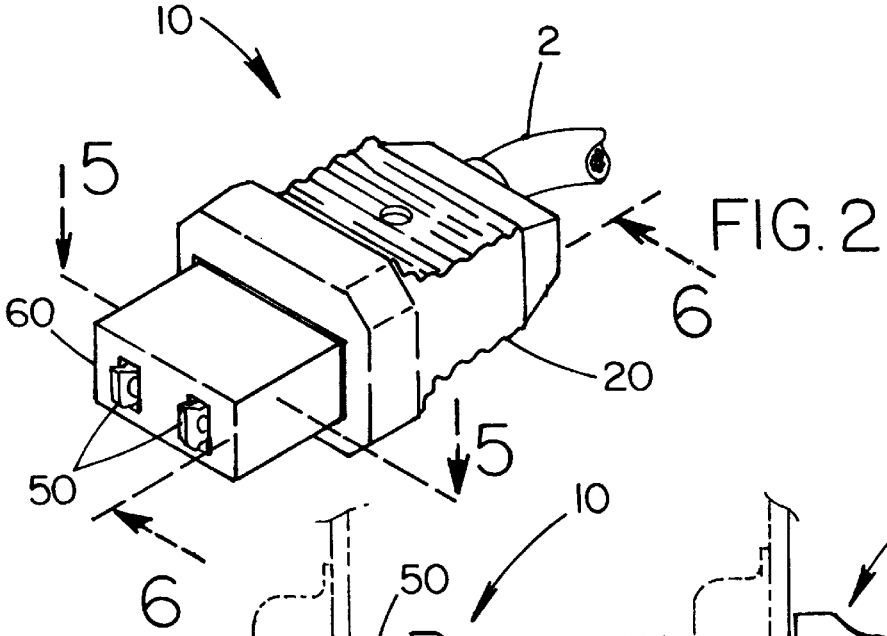
FIG. 2 is a perspective view of the present invention.
Figure 3:
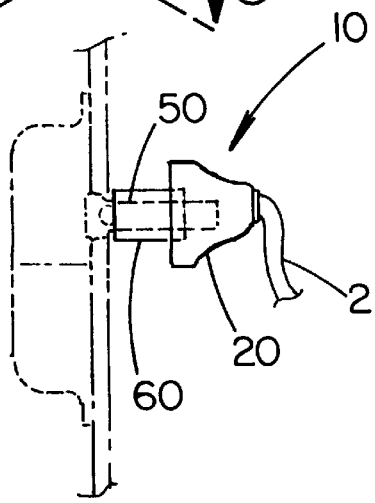
FIG. 3 is a side view of the present invention particularly illustrating the blade cover member in an extended position.
Figure 4:
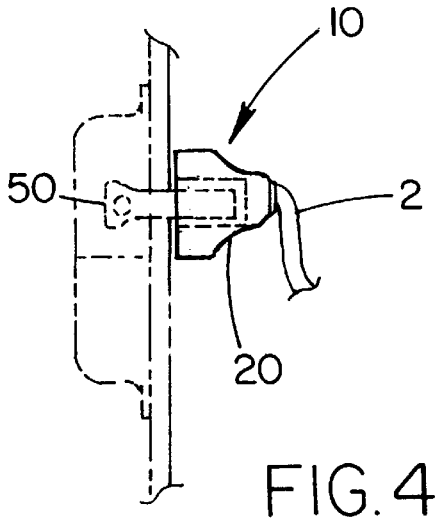
FIG. 4 is a side view of the present invention particularly illustrating the blade cover member in a retracted position.

With reference now to the drawings, and in particular to FIGS. 1 through 8 thereof, a new electrical plug with retractible blade cover member embodying the principles and concepts of the present invention and generally designated by the reference numeral 10 will be described.

As best illustrated in FIGS. 1 through 8, the electrical plug with retractible blade cover member 10 comprises a casing 20 with a pair of blade members 50 that extend through the casing 20. A portion of each of the blade members 50 protrudes outwardly from the inner portion 44 of the front 40 of the casing 20. The front 40 of the casing 20 has a generally annular cover receiving channel 43. The cover receiving channel 43 extends from the front 40 of the casing 20 towards the back 25 of the casing 20. A blade cover member 60 is slidably inserted in the cover receiving channel 43. The outlet contacting portion 61 of the blade cover member 60 has a pair of spaced apart openings 65 through which the blade members 50 extend.

The casing 20 has a front 40, a back 25, a pair of ends 26, and a pair of sides 27 that extend between the ends 26. Preferably, the casing 20 is formed from separable first and second casing portions 21,22.

Also preferably, the casing 20 has an interior space that is positioned towards the back 25 of the casing 20. A portion of each of the casing portions 21,22 define the interior space. The interior space is bifurcated and has a pair of chambers 28 into which the blade members 50 extend. The back 25 of the casing 20 has an opening 29 into the interior space of the casing 20 for inserting an electrical cable 2 that contacts the blade members 50.

Preferably, each of the casing portions 21,22 has a wire clamp rib 30 that extends outwardly into the interior space of the casing 20 from a respective casing portion 21,22. The wire clamp ribs 30 are positioned such that they clamp down on an electrical cable 2 that is inserted into the interior space of the casing 20 when the casing portions 21,22 are placed together.

Also preferably, the casing 20 has a fastener hole 31 that extends through the casing 20 between the ends 26 of the casing 20. The fastener hole 31 receives a fastener (not shown), such as a screw or bolt and nut, that couples the first and second casing portions 21,22 together.

The front 40 of the casing 20 has an outer portion 41, a generally annular cover receiving channel 43 for receiving the blade covering member and springs 75 that bias the blade cover member 60 towards an extended position, and an inner portion 44 that is defined by the cover receiving channel 43. The cover receiving channel 43 extends from the front 40 of the casing 20 towards the back 25 of the casing 20.

Figure 6:
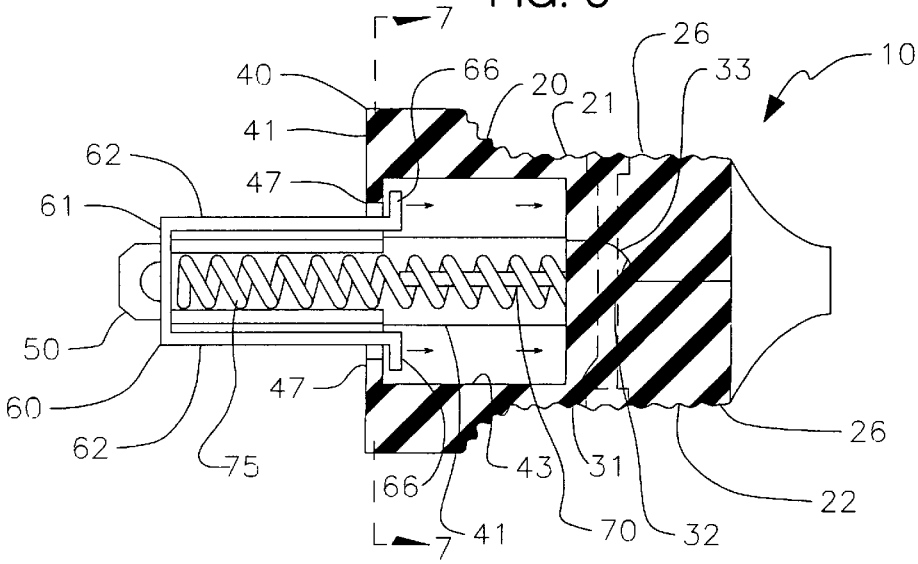
FIG. 6 is a cross-sectional view of the present invention taken from Line 6—6 of FIG. 2.
Figure 7:
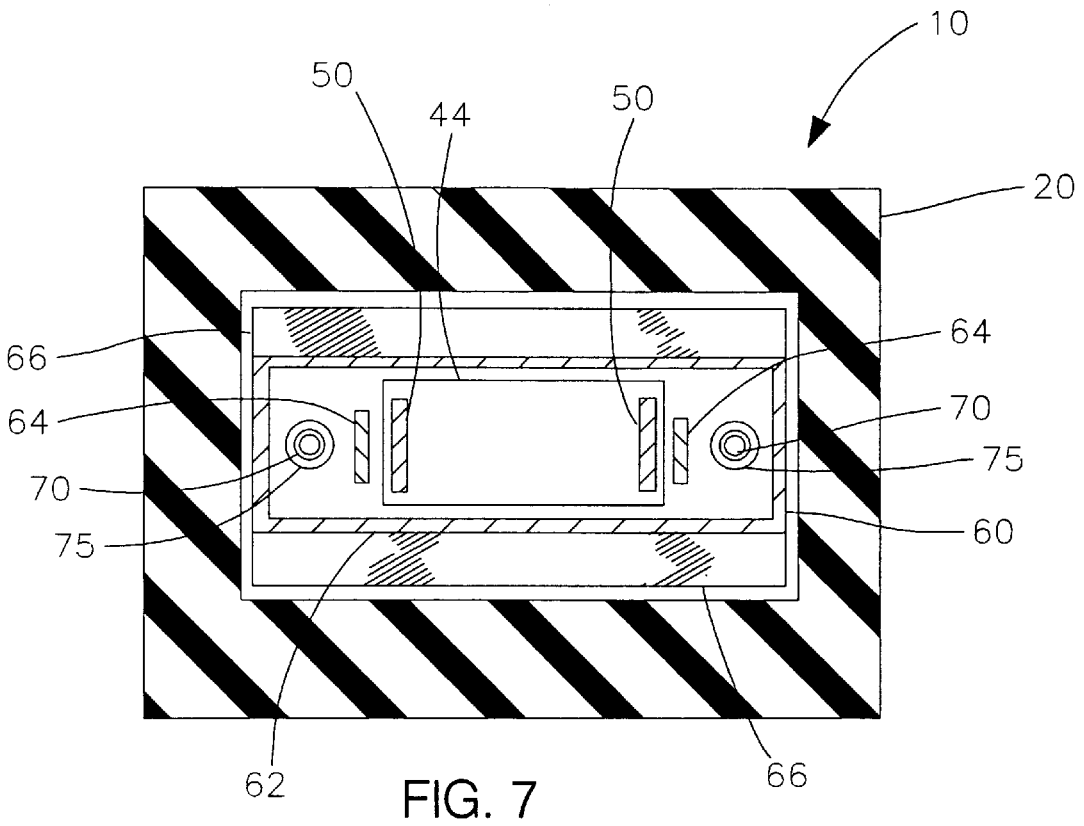
FIG. 7 is a cross-sectional view of the present invention taken from Line 7—7 of FIG. 6.

Preferably, as illustrated in FIG. 6, the first casing portion 21 has a groove 32 that is positioned adjacent the cover receiving channel 43. The second casing portion 22 has a tongue portion 33 that is positioned adjacent the cover receiving channel 43. The tongue portion 33 extends into the groove 32 of the first casing portion 21.

Also preferably, the front 40 of the casing 20 has a pair of blade receiving slots 46 that receive the blade members 50 that extend through the casing 20 from the cover receiving channel 43 into the interior space of the casing 20. The blade receiving slots 46 are spaced apart.

The spaced apart blade members 50 extend through the blade receiving slots 46 of the casing 20. A portion of each of the blade members 50 protrudes outwardly from the inner portion 44 of the front 40 of the casing 20. Preferably, the lengths of the blade members 50 are generally parallel one another. Another portion of each of the blade members 50 protrudes into an associated chamber 28 of the interior space of the casing 20.

Preferably, as shown in FIG. 6, the outer portion 41 of the front 40 of the casing 20 has a pair of lip portions 47 that extend into the cover receiving channel 43. One of the lip portions 47 is positioned towards one of the ends 26 of the casing 20. Another of the lip portions 47 is positioned towards another of the ends 26 of the casing 20.

The blade cover member 60 is slidably inserted in the cover receiving channel 43. The blade cover member 60 has an outlet contacting portion 61, a pair of end walls 62, and a pair of sidewalls 63 that extend between the end walls 62.

Figure 5:
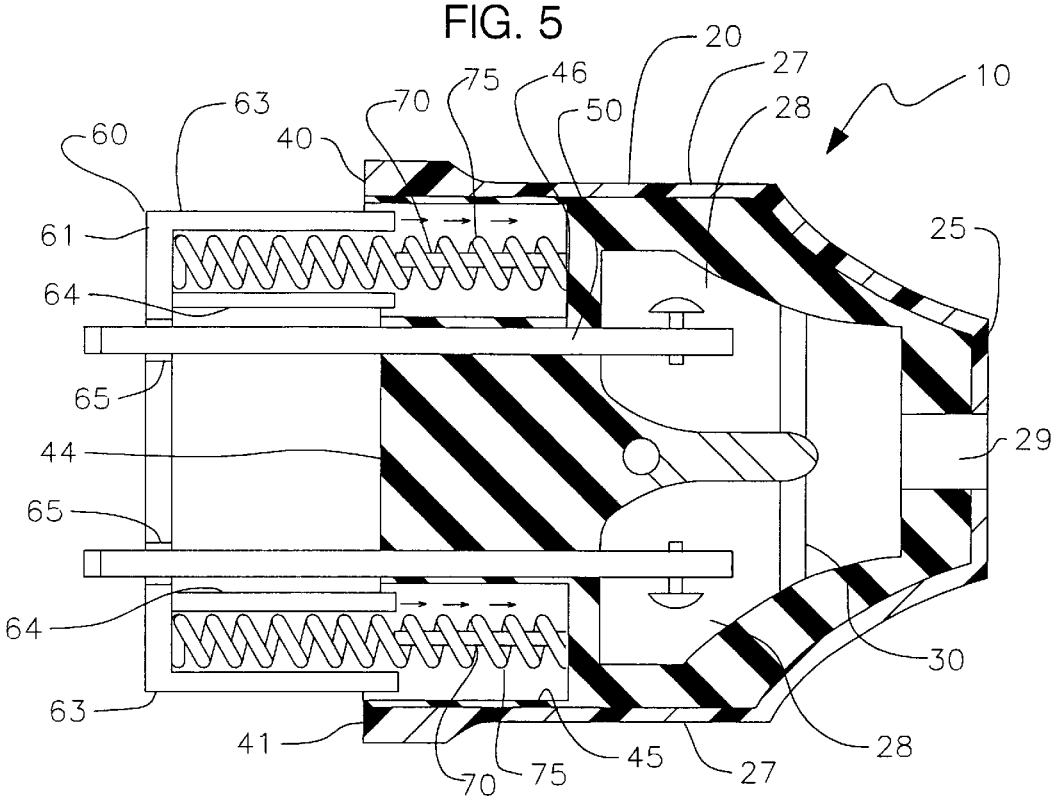
FIG. 5 is a cross-sectional view of the present invention taken from Line 5—5 of FIG. 2.
Figure 8:
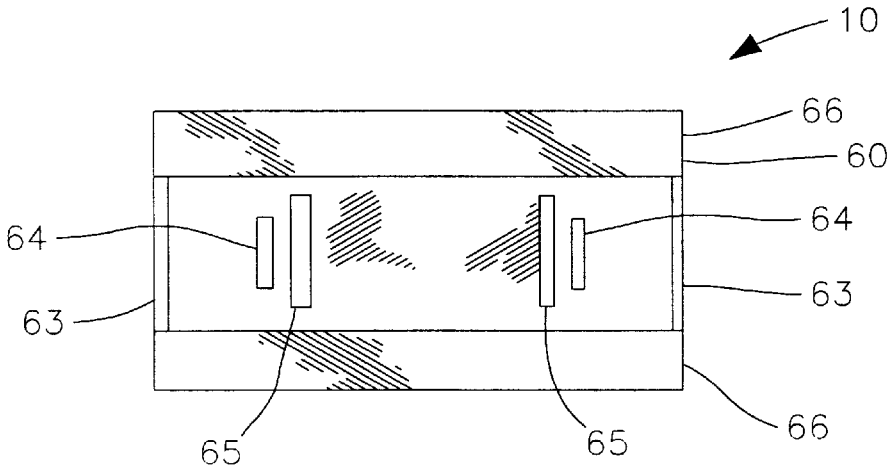
FIG. 8 is a side view of the interior of the blade cover member of the present invention.

Preferably, as best illustrated in FIGS. 5 and 8, a pair of inner guide members 64 extend from the outlet contacting portion 61 of the blade cover member 60 towards the casing 20. One of the inner guide members 64 is spaced apart from one of the sidewalls 63 of the blade cover member 60. Another of the inner guide members 64 is spaced apart from another of the sidewalls 63 of the blade cover member 60.

Also preferably, the blade cover member 60 is slidable between an extended position and a retracted position. The outlet contacting portion 61 of the blade cover member 60 is positioned substantially flush with the lip portions 47 of the front 40 of the casing 20 when the blade cover member 60 is in a retracted position. The outlet contacting portion 61 of the blade cover member 60 is spaced apart from the front 40 of the casing 20 when the blade cover member 60 is in an extended position. Even more preferably, the portions of each of the blade members 50 that protrude outwardly from the front 40 of the casing 20 are substantially covered by the blade cover member 60 when the blade cover member 60 is in an extended position.

Also preferably, the blade cover member 60 is biased towards the extended position. Even more preferably, a pair of springs 75 bias the blade cover member 60 towards the extended position. The use of two springs 75 is preferable to the use of one in that the possibility of the blade cover member 60 becoming misaligned and stuck in the cover receiving channel 43 is reduced.

Preferably, each of the springs 75 extends between the tongue portion 33 of the second casing portion 22 and the outlet contacting portion 61 of the blade cover member 60. One of the springs 75 is positioned between one of the inner guide members 64 of the blade cover member 60 and a respective sidewall 63 of the blade cover member 60. Another of the springs 75 is positioned between another of the inner guide members 64 of the blade cover member 60 and a respective sidewall 63 of the blade cover member 60. Such positioning assists in keeping the springs 75 aligned.

Also preferably, each of the end walls 62 of the blade cover member 60 has a flanged portion 66. Each flanged portion 66 abuts an associated lip portion 47 of the casing 20 when the blade cover member 60 is positioned in an extended position. The lip portions 47 prevent the blade cover member 60 from becoming removed from the casing 20.

Preferably, a pair of guide pins 70 outwardly extend into the cover receiving channel 43 from the tongue member of the second casing portion 22. Even more preferably, the guide pins 70 are substantially parallel with the blade members 50.

Most preferably, each of the springs 75 is disposed around a respective guide pin 70 to keep the spring aligned and from buckling and possibly blocking the retraction of the blade cover member 60.

In use, the electrical plug with retractible blade cover member 10 is positioned towards an electrical outlet 1 such that the blade members 50 are insertable into the outlet 1. As the blade members 50 are inserted into the outlet 1, the outlet contacting portion 61 of the blade cover member 60 abuts the outlet 1 and the blade cover member 60 retracts into the cover receiving channel 43 towards a retracted position. The springs 75 keep the blade cover member 60 in contact with the outlet 1, thereby keeping the blade members 50 covered. If the blade members 50 become partially dislodged from the outlet 1, the blade cover member 60 extends to cover the blade members 50. When the blade members 50 are removed from the outlet 1, the blade cover member 60 extends towards an extended position.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An electrical plug, comprising:

a casing having a front, a back, a pair of ends, and a pair of sides extending between said ends;

said front of said casing having an outer portion, a generally annular cover receiving channel, and an inner portion being defined by said cover receiving channel, wherein said cover receiving channel extends from said front of said casing towards said back of said casing;

a pair of blade members being extended through said casing, a portion of each of said blade members protruding outwardly from said inner portion of said front of said casing;

a blade cover member being slidably inserted in said cover receiving channel, said blade cover member having an outlet contacting portion, a pair of end walls, and a pair of sidewalls extending between said end walls; and wherein said outlet contacting portion of said blade cover member has a pair of spaced apart openings, said blade members extending through said openings of said outlet contacting portion of said blade cover member;

a pair of inner guide members being extended from said outlet contacting portion of said blade cover member towards said casing, one of said inner guide members being spaced apart from one of said sidewalls of said blade cover member, another of said inner guide members being spaced apart from another of said sidewalls of said blade cover member; and wherein a pair of springs bias said blade cover member away from said front of said casing, one of said springs being positioned between one of said inner guide members of said blade cover member and a respective said sidewall of said blade cover member, another of said springs being positioned between another of said inner guide members of said blade cover member and a respective said sidewall of said blade cover member.

2. The electrical plug of claim 1, wherein said casing has separable first and second casing portions, said first casing portion having a groove being positioned adjacent said cover receiving channel, said second casing member having a tongue portion being positioned adjacent said cover receiving channel, said tongue portion being extended into said groove of said first casing portion.

3. The electrical plug of claim 1, wherein said outer portion of said front of said casing has a pair of lip portions being extended into said cover receiving channel, one of said lip portions being positioned towards one of said ends of said casing, another of said lip portions being positioned towards another of said ends of said casing.

4. The electrical plug of claim 1, wherein said blade cover member is slidable between an extended position and a retracted position, said outlet contacting portion of said blade cover member being positioned substantially flush with said front of said casing when said blade cover member is in said retracted position, said outlet contacting portion of said blade cover member being spaced apart from said front of said casing when said blade cover member is in said extended position.

5. The electrical plug of claim 4, wherein said portions of each of said blade members protruding outwardly from said front of said casing are substantially covered by said blade cover member when said blade cover member is in said extended position.

6. The electrical plug of claim 3, wherein each of said end walls of said blade cover member has a flanged portion, wherein each said flanged portion abuts an associated lip portion when said blade cover member is positioned in an extended position.

7. The electrical plug of claim 1, further comprising a pair of guide pins being outwardly extended into said cover receiving channel from said front of said casing.

8. The electrical plug of claim 4, wherein said blade cover member is biased towards said extended position.

9. The electrical plug of claim 8, wherein a pair of springs bias said blade cover member towards said extended position, each of said springs being extended between said front of said casing and said outlet contacting portion of said blade cover member.

10. The electrical plug of claim 7, wherein a pair of springs bias said blade cover member towards said extended position, each of said springs being extended between said front of said casing and said outlet contacting portion of said blade cover member, each of said springs being disposed around a respective said guide pin.

11. An electrical plug, comprising:

a casing having separable first and second casing portions, a front, a back, a pair of ends, and a pair of sides extending between said ends;

said front of said casing having an outer portion, a generally annular cover receiving channel, and an inner portion being defined by said cover receiving channel, said cover receiving channel extending from said front of said casing towards said back of said casing;

said first casing portion having a groove being positioned adjacent said cover receiving channel;

said second casing portion having a tongue portion being positioned adjacent said cover receiving channel, said tongue portion being extended into said groove of said first casing portion;

a pair of spaced apart blade members being extended through said casing, wherein a portion of each of said blade members protrudes outwardly from said inner portion of said front of said casing;

said outer portion of said front of said casing having a pair of lip portions being extended into said cover receiving channel, one of said lip portions being positioned towards one of said ends of said casing, another of said lip portions being positioned towards another of said ends of said casing;

a blade cover member being slidably inserted in said cover receiving channel, said blade cover member having an outlet contacting portion, a pair of end walls, and a pair of sidewalls extending between said end walls;

a pair of inner guide members being extended from said outlet contacting portion of said blade cover member towards said casing, one of said inner guide members being spaced apart from one of said sidewalls of said blade cover member, another of said inner guide members being spaced apart from another of said sidewalls of said blade cover member;

wherein said outlet contacting portion of said blade cover member has a pair of spaced apart openings, said blade members extending through said openings of said outlet contacting portion of said blade cover member;

said blade cover member being slidable between an extended position and a retracted position, said outlet contacting portion of said blade cover member being positioned substantially flush with said lip portions of said front of said casing when said blade cover member is in said retracted position;

wherein said outlet contacting portion of said blade cover member is spaced apart from said front of said casing when said blade cover member is in said extended position;

wherein said portions of each of said blade members protruding outwardly from said front of said casing are substantially covered by said blade cover member when said blade cover member is in said extended position;

wherein each of said end walls of said blade cover member has a flanged portion, wherein each said flanged portion abuts an associated lip portion when said blade cover member is positioned in said extended position;

a pair of guide pins being outwardly extended into said cover receiving channel from said tongue member of said second casing portion;

said blade cover member being biased towards said extended position, wherein a pair of springs bias said blade cover member towards said extended position;

wherein each of said springs extends between said tongue of said second casing portion and said outlet contacting portion of said blade cover member;

each of said springs being disposed around a respective said guide pin;

wherein one of said springs is positioned between one of said inner guide members of said blade cover member and a respective said sidewall of said blade cover member; and wherein another of said springs is positioned between another of said inner guide members of said blade cover member and a respective said sidewall of said blade cover member.

* * * * *